US008534539B2

(12) United States Patent
Doi et al.

(10) Patent No.: US 8,534,539 B2
(45) Date of Patent: Sep. 17, 2013

(54) VALUABLE MEDIUM PROCESSING SYSTEM

(75) Inventors: Kazuhiro Doi, Hyogo (JP); Koichi Nishida, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 0 days.

(21) Appl. No.: 13/498,936

(22) PCT Filed: Sep. 30, 2009

(86) PCT No.: PCT/JP2009/067093

§ 371 (c)(1), (2), (4) Date: Mar. 29, 2012

(87) PCT Pub. No.: WO2011/039872

PCT Pub. Date: Apr. 7, 2011

(65) Prior Publication Data

US 2012/0181327 A1 Jul. 19, 2012

(51) Int. Cl.
*G07G 1/00* (2006.01)

(52) U.S. Cl.
USPC ..... 235/2; 235/379

(58) Field of Classification Search
USPC ..... 235/2, 379
See application file for complete search history.

(56) References Cited

U.S. PATENT DOCUMENTS

2002/0030101 A1 3/2002 Inoue et al.

FOREIGN PATENT DOCUMENTS

| | | |
|---|---|---|
| JP | 03-063797 | 3/1991 |
| JP | 10-011665 | 1/1998 |
| JP | 10-241015 | 9/1998 |
| JP | 3330801 | 7/2002 |
| JP | 2009-193144 | 8/2009 |

*Primary Examiner* — Daniel Hess
(74) *Attorney, Agent, or Firm* — Renner, Kenner, Greive, Bobak, Taylor & Weber

(57) ABSTRACT

Provided is a valuable medium processing system capable of improving the work efficiency of a person in charge when continuously storing a quantity of valuable media collected from a plurality of valuable medium transaction machines into a storage unit. The valuable medium processing system comprises: a valuable medium processing machine for performing a count process on a predetermined kind of valuable media from among the valuable media collected from the valuable medium transaction machines; and a control machine for storing and managing the quantity of valuable media collected from the valuable medium transaction machines on a per valuable medium transaction machine basis. While the processing machine is performing the counting process on the valuable media collected from one of the valuable medium transaction machines, if the quantity of valuable media which are collected from a different valuable medium transaction machine and on which the processing machine cannot perform the counting process is inputted by an input operation means, the control machine controls a predetermined storage means to store the inputted quantity of valuable media as the quantity of valuable media collected from the different valuable medium transaction machine.

5 Claims, 8 Drawing Sheets

| CASH REGISTER NO. | GIFT VOUCHER A | CASH (BANKNOTE) | CASH (COIN) | TOTAL OF MANUAL INPUT |
|---|---|---|---|---|
| 0001 | $10.00 | $22.00 | $0.25 | $32.25 |
| 0002 | $5.00 | $13.00 | $1.32 | $19.32 |
| 0003 | | | | |
| 0004 | | | | |
| 0005 | | | | |
| 0006 | | | | |
| 0007 | | | | |
| 0008 | | | | |
| 0009 | | | | |
| 0010 | | | | |

FIG.2-2F
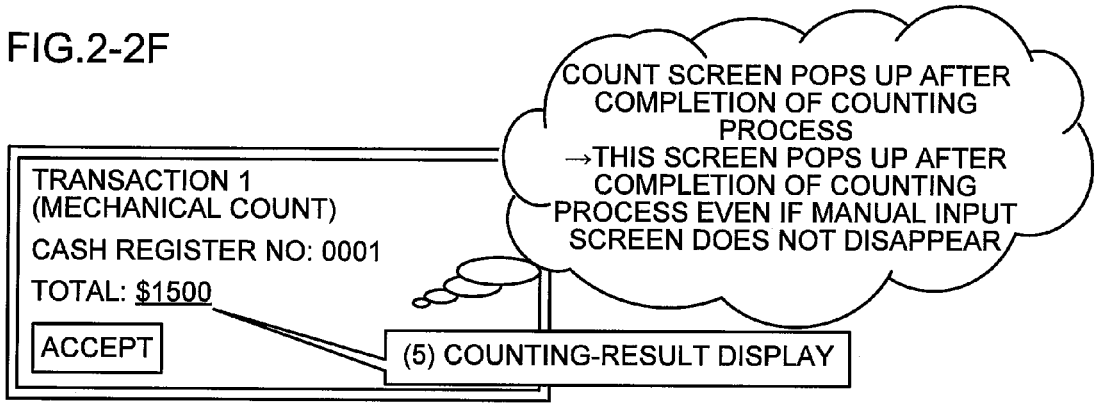
FIG.2-2G
| CASH REGISTER NO. | GIFT VOUCHER A | CASH (BANKNOTE) | CASH (COIN) | TOTAL OF MANUAL INPUT |
|---|---|---|---|---|
| 0001 | $10.00 | $22.00 | $0.25 | $32.25 |
| 0002 | $5.00 | $13.00 | $1.32 | $19.32 |
| 0003 | $6.00 | $14.00 | $2.32 | $22.32 |
| 0004 | $7.00 | $15.00 | $3.32 | $25.32 |
| 0005 | $8.00 | $16.00 | $4.32 | $28.32 |
| 0006 | $9.00 | $17.00 | $5.32 | $31.32 |
| 0007 | $10.00 | $18.00 | $6.32 | $34.32 |
| 0008 | $11.00 | $19.00 | $7.32 | $37.32 |
| 0009 | $12.00 | $20.00 | $8.32 | $40.32 |
| 0010 | $13.00 | $21.00 | $9.32 | $43.32 |
OK
MANUAL INPUT DATA IS CONTINUOUSLY INPUT FOR ITEMS OF EACH CASH REGISTER
FIG.2-2H
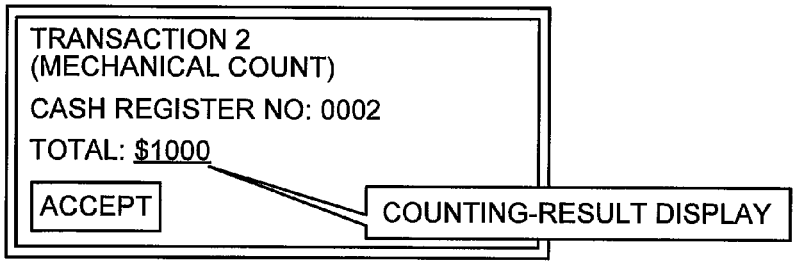
FIG.2-2I
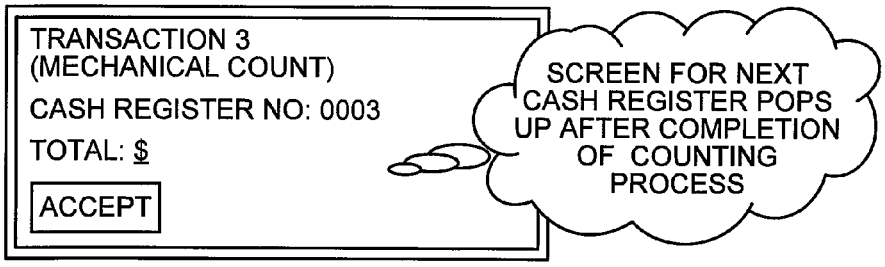

VALUABLE MEDIUM PROCESSING SYSTEM

TECHNICAL FIELD

The present invention relates to a valuable medium processing system.

BACKGROUND ART

A valuable medium processing system is typically installed in back office of department stores, supermarkets, etc. The valuable medium processing system performs a counting process on valuable media such as sales proceeds collected from cash registers (hereinafter, "registers). As an example of such a valuable medium processing system, a system is disclosed in Patent Document 1 that includes a set of a valuable-medium processing machine (hereinafter, "processing machine") that recognizes currency to automatically performs a counting process on the currency and a control apparatus (hereinafter, "terminal") that causes the processing machine to perform a process such as counting of the currency in response to an operation of a register operator or a specific teller (hereinafter collectively referred to as "operator") who performs a totaling operation for sales proceeds, etc., and manages valuable media such as sales proceeds.

In such a valuable medium processing system including the set of the processing machine and the terminal, based on the operation of the terminal performed by the operator, the processing machine recognizes deposited currency to automatically perform a counting process on the currency, stores the obtained result in a predetermined storage unit, causing the processing machine to accommodate the counted currency, thereby totaling and managing the sales proceeds, etc.

Furthermore, in such a conventional valuable medium processing system, when valuable media such as gift vouchers, coupons, and torn banknotes that cannot be recognized by the processing machine are included in the sales proceeds collected from the cash register, the operator manually inputs the numerical quantity of such valuable media to the terminal, stores the numerical quantity of the sales proceeds in the predetermined storage unit in the terminal, and manages the sales proceeds.

Such a valuable-medium processing machine also includes a display unit that displays graphics that indicate an operational state of the processing machine and graphics for guidance of the operation of the terminal for the operator. The display unit displays thereon textual information such as "COUNTING PROCESS ONGOING" while the processing machine automatically performing a counting process on the currency, and displays a processing result when the counting process ends. After the operator performs an operation for approving the processing result, the display unit displays graphics for guidance of a next operation to be performed by the operator.

Based on the graphics displayed on the display unit, the operator first causes the processing machine to perform a counting process on the currency collected from a certain cash register and stores the totaling result in the terminal. Next, the operator sequentially manually inputs numerical quantities of valuable media that are collected from the cash register and cannot be recognized by the processing machine, causing the terminal to store the totaling result of all the valuable media collected from the cash register. Then, the operator totals valuable media collected from another cash register. The operator repeats these operations to perform a totaling operation for the valuable media such as sales proceeds collected from a plurality of cash registers.

Patent Document 1: Japanese Patent No. 3330801

DISCLOSURE OF INVENTION

Problem to be Solved by the Invention

However, in the conventional valuable medium processing system, in which the processing machine automatically performs a counting process on valuable media which can be recognized by the processing machine, and in which the operator manually inputs to the terminal the numerical quantity of valuable media which cannot be recognized by the processing machine, it is difficult to improve the work efficiency of the operator when the operator inputs numerical quantities of valuable media collected from a plurality of cash registers to the terminal on a cash register basis.

Generally, almost all of valuable media collected from a cash register are currency that can be recognized by the processing machine, and numerical quantities of other valuable media such as gift vouchers and coupons that cannot be recognized by the processing machine is significantly small in comparison with the currency.

Therefore, in the conventional valuable medium processing system, when the operator continuously totals valuable media collected from the cash registers on a cash register basis to store the total result in the terminal, there may arise a situation where before the processing machine ends a counting process on currency collected from a certain cash register, manual inputting of the numerical quantity of valuable media that are collected from the cash register and cannot be recognized by the processing machine may be completed.

In this case, even though the operator ends the input operation for the numerical quantity of valuable media pertaining to sales proceeds collected from a certain cash register, the next totaling operation cannot be started for valuable media collected from another cash register. Therefore, it is difficult to improve efficiency of these operations.

It is an object of the present invention to provide a valuable medium processing system that can improve the work efficiency of the operator when the numerical quantity of valuable media collected from a plurality of valuable-medium transaction machines such as cash registers is to be stored in a control machine such as a terminal for each of the valuable-medium transaction machines.

Means for Solving Problem

To solve the above problems and to achieve the above objects, according to an aspect of the present invention, a valuable medium processing system includes a valuable-medium processing machine that performs a counting process on a predetermined kind of valuable medium among valuable media collected from a plurality of valuable-medium transaction machines that conduct a transaction of the valuable medium; and a control machine that stores therein and manages, for each of the valuable-medium transaction machines, the numerical quantity of the valuable media that were collected from the valuable-medium transaction machines. The valuable-medium processing machine includes a recognition unit that recognizes the predetermined kind of the valuable medium among the valuable media collected from the valuable-medium transaction machines, and a counting unit that performs a counting process on the valuable media that can be recognized by the recognition unit. The control machine includes an input operation unit used for inputting the numerical quantity of valuable media that cannot be recognized by the recognition unit, and a storage unit that stores therein the numerical quantity of the valuable media that is input through the input operation unit and a counting result obtained by the counting unit. When continuously storing in the storage unit the numerical quantity of the valuable media collected from each of the valuable-medium transaction machines, when the numerical quantity for a second valuable-medium transaction machine among the valuable-medium transaction machines is input by the input operation unit while the counting unit is currently performing the counting process on valuable media for a first valuable-medium transaction machine among the valuable-medium transaction machines, the numerical quantity of the valuable media that was input for the second valuable-medium transaction machine is stored in the storage unit separately from the numerical quantity of the valuable media for the first valuable-medium transaction machine.

According to another aspect of the present invention, in the valuable medium processing system, the control machine includes a registration unit that registers beforehand the order of the valuable-medium transaction machines that cause the storage unit to store the respective numerical quantities of the valuable media collected from the valuable-medium transaction machines, a display unit that displays graphics pertaining to a process to be performed on the valuable media, and a display control unit that exerts display control on the display unit. The display control unit displays graphics for input process to prompt an operator to input through the input operation unit the numerical quantity of the valuable media collected from each of the valuable-medium transaction machines during the counting process, in the order of the valuable-medium transaction machines registered by the registration unit.

According to still another aspect of the present invention, in the valuable medium processing system, the control machine is connected to the valuable-medium transaction machines via a communication line, and the registration unit registers beforehand the order of the valuable-medium transaction machines based on registration information received from the valuable-medium transaction machines that cause the storage unit to store the respective numerical quantities of the valuable media collected from the valuable-medium transaction machines.

According to still another aspect of the present invention, in the valuable medium processing system, the control machine includes an identification information reading unit that reads identification information from a recording medium that records thereon the identification information assigned for identifying the valuable-medium transaction machines. The registration unit registers into the order of the valuable-medium transaction machines the valuable-medium transaction machine corresponding to the identification information that is read by the identification information reading unit so as to change the order of the valuable-medium transaction machines from which the valuable media are collected and the respective numerical quantity of the collected valuable media are stored in the storage unit.

According to still another aspect of the present invention, in the valuable medium processing system, when the counting process is completed while the graphics for the input process has been displayed, the display control unit highlights resultant graphics indicating the completion of the counting process on the display unit.

Advantages of the Invention

According to an aspect of the present invention, a valuable medium processing system is provided that includes a valuable-medium processing machine that performs a counting process on a predetermined kind of valuable medium among valuable media collected from a plurality of valuable-medium transaction machines that perform a transaction of the valuable medium, and a control machine that stores therein and manages the numerical quantity of the valuable media collected from the valuable-medium transaction machines for each of the valuable-medium transaction machines. The valuable-medium processing machine includes a recognition unit that recognizes the predetermined kind of the valuable medium among the valuable media collected from the valuable-medium transaction machines, and a counting unit that performs a counting process on the valuable media that can be recognized by the recognition unit. The control machine includes an input operation unit used for inputting the numerical quantity of valuable media that cannot be recognized by the recognition unit, and a storage unit that stores therein the numerical quantity of the valuable media that is input through the input operation unit and a counting result obtained by the counting unit. While the counting unit performs the counting process on valuable media collected from one of the valuable-medium transaction machines in the case of continuously storing in the storage unit the numerical quantity of the valuable media collected from the plurality of valuable-medium transaction machines, when the numerical quantity of valuable media collected from another valuable-medium transaction machine is input through the input operation unit, the numerical quantity of the valuable media that was input is stored in the storage unit as the numerical quantity of the valuable media collected from the other valuable-medium transaction machine. Therefore, the valuable medium processing system can improve the work efficiency of an operator when the numerical quantity of the valuable media collected from the plurality of valuable-medium transaction machines is stored in the control machine for each of the valuable-medium transaction machine.

According to another aspect of the present invention, the control machine includes a registration unit that registers beforehand the order of the valuable-medium transaction machines that cause the storage unit to store the numerical quantity of the valuable media collected from the valuable-medium transaction machines, a display unit that displays graphics pertaining to a process to be performed on the valuable media, and a display control unit that exerts display control on the display unit. The display control unit displays graphics for input process to prompt an operator to input through the input operation unit the numerical quantity of the valuable media collected from each of the valuable-medium transaction machines during the counting process, in the order of the valuable-medium transaction machines registered by the registration unit. Therefore, when inputting of the numerical quantity of valuable media collected from a certain valuable-medium transaction machine through the input operation unit is completed while the processing machine is performing the counting process on the valuable media, the numerical quantity of valuable media collected from another valuable-medium transaction machine that is registered beforehand can be continuously input through an input operation, leading to an improvement of the work efficiency of the operator.

According to still another aspect of the present invention, the control machine is connected to the valuable-medium transaction machines via a communication line, and the registration unit registers beforehand the order of the valuable-medium transaction machines based on registration information received from the valuable-medium transaction machines that cause the storage unit to store the numerical quantity of the valuable media collected from the valuable-medium transaction machines. Therefore, in cases when storing for each valuable-medium transaction machine in the control machine the numerical quantity of the valuable media collected from the plurality of valuable-medium transaction machines, an operation for registering a valuable-medium transaction machine, from which the valuable media are collected and the numeral quantity of the collected valuable media are stored in the storage unit, in each case is not necessary. This improves the work efficiency of the operator.

According to still another aspect of the present invention, the control machine includes an identification information reading unit that reads identification information from a recording medium that records thereon the identification information assigned for identifying the valuable-medium transaction machines. The registration unit interruptingly registers the valuable-medium transaction machine corresponding to the identification information that is read by the identification information reading unit into the order of the valuable-medium transaction machines that cause the storage unit to store the numerical quantity of the valuable media collected from the valuable-medium transaction machines. Therefore, for example, when the operator of a valuable-medium transaction machine performs a totaling operation for valuable media collected from the valuable-medium transaction machine, when the valuable medium processing system is vacant even if a totaling operation pertaining to another valuable-medium transaction machine is previously registered in the control machine, merely by presenting the recording medium so that the control machine reads the identification information recorded on the recording medium, the user can perform the totaling operation for the valuable media without waiting for a turn at the end of the queue of previously registered machines. This improves the work efficiency of the operator.

According to still another aspect of the present invention, when the counting process is completed while the graphics for the input process has been displayed, the display control unit highlights resultant graphics indicating the completion of the counting process on the display unit. Therefore, even if inputting the numerical quantity of valuable media through the input operation unit, the operator can readily know the completion of the counting process performed by the processing machine. For example, a preparation operation for next valuable media continuously undergoing the counting process performed by the processing machine can be efficiently performed. This improves operability of the valuable medium processing system and the work efficiency of the operator.

BRIEF DESCRIPTION OF DRAWINGS

FIG. 2-1 depicts examples of graphics displayed on a display unit of a terminal according to the present embodiment.

FIG. 2-2 depicts examples of graphics displayed on the display unit of the terminal according to the present embodiment.

FIG. 3-1 depicts examples of graphics displayed on the display unit of the terminal according to the present embodiment.

FIG. 3-2 depicts examples of graphics displayed on the display unit of the terminal according to the present embodiment.

EXPLANATIONS OF LETTERS OR NUMERALS

Figure 1:
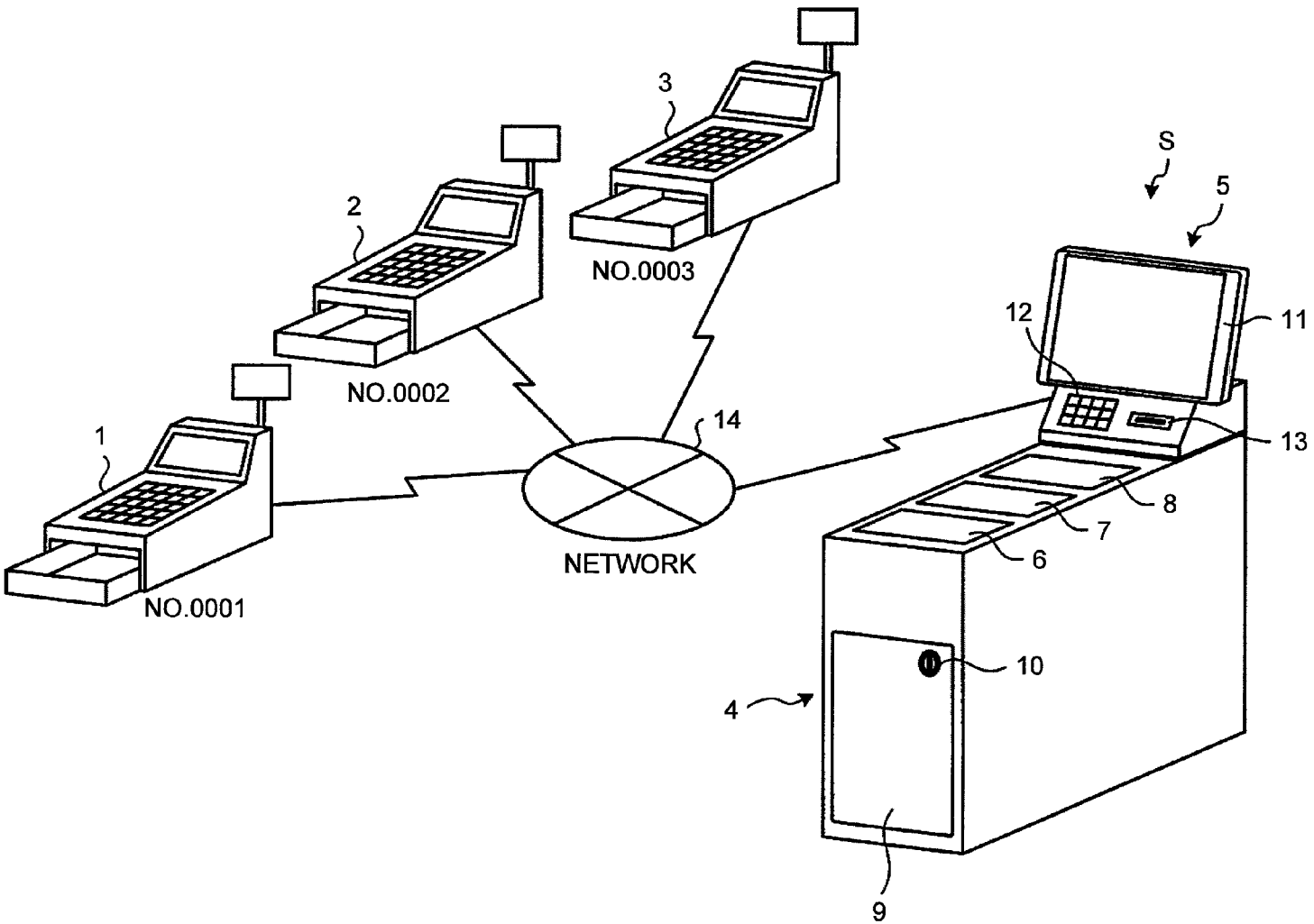
FIG. 1 is a schematic drawing of the whole of a valuable medium processing system according to an embodiment of the present invention.

S: Valuable medium processing system
1 to 3: Cash register
4: Processing machine
5: Terminal
6: Inlet unit
7: Outlet unit
8: Returning unit
11: Display unit
12: Operating unit
13: Card reader unit
20: Control unit of Terminal
21: Registering unit
22: Storage unit
23: Display control unit
24: Communication unit
30: Control unit
31: Counting unit
32: Recognition processing unit
33: Transport control unit
34: Transport mechanism
35: Communication unit
36: Denomination-wise accommodating unit

BEST MODE(S) FOR CARRYING OUT THE INVENTION

Exemplary embodiments of a valuable medium processing system according to the present invention are explained below in detail with reference to the accompanying drawings. FIG. 1 is a schematic drawing of the whole of a valuable medium processing system S according to an embodiment of the present invention.

In the present embodiment, an embodiment is presented in which the present invention is applied to a system that continuously totals valuable media such as sales proceeds collected from a plurality of cash registers installed in a retail store such as a supermarket on a cash register basis to store and manage the total result of the valuable media. However, the present invention can also be applied to other systems that include a valuable-medium processing machine that performs a counting process on a predetermined kind of valuable medium among valuable media collected from a plurality of valuable-medium transaction machines that conduct a transaction of valuable media and a control machine that stores and manages the numerical quantity of the valuable media collected from the valuable-medium transaction machines for each of the valuable-medium transaction machine. The present invention can be applied to any system that totals collected valuable media for each transaction pertaining to the valuable media to store and manage the total result of the valuable media, for example, to a system that totals valuable media collected from a plurality of teller machines installed at a teller window of a financial institution on a teller machine basis to store and manage the total result of the valuable media.

As shown in FIG. 1, the valuable medium processing system S according to the present embodiment includes a processing machine 4 that, for example, performs a totaling process on sales proceeds collected from each of a plurality of electronic cash registers (hereinafter, "cash registers 1 to 3") and a terminal 5 that causes the processing machine 4 to perform a totaling process on the sales proceeds based on an operation performed by operators of the cash registers 1 to 3 (hereinafter, "cashiers") or predetermined person in charge of accounts (hereinafter, "teller") and that stores and manages the sales proceeds collected from each of the cash registers 1 to 3 for each of the cash registers 1 to 3. In the following explanation, when the cashier does not need to be distinguished from the teller, they are collectively referred to as "operators".

Each of the cash registers 1 to 3 is an apparatus installed at a shop-front counter and operated by the cashier when customers pay for purchases. In the present embodiment, these cash registers 1 to 3 correspond to the plurality of valuable-medium transaction machines that conducts a transaction of valuable media in the present invention.

The cash registers 1 to 3 temporarily keep therein various valuable media such as cash, gift vouchers, and coupons paid for the purchases by customers. Sales proceeds temporarily kept in the cash registers 1 to 3 are collected by the cashiers assigned to the cash registers 1 to 3, respectively, and are transported to a predetermined cash room provided in a back office of a retail store, for example, after the close of business at the retail store.

Each of the cash registers 1 to 3 is assigned a unique cash register No. as identification information for distinguishing the cash registers 1 to 3 from each other. The cash registers 1 to 3 are assigned "0001", "0002", and "0003", respectively, as the cash register Nos.

When totaling and managing sales proceeds in the retail store, the sales proceeds collected from the cash registers 1 to 3 are totaled for each of the cash registers 1 to 3 based on these cash register Nos. and are stored in the terminal 5 described below in detail. Specifically, sales proceeds collected from each of the cash registers 1 to 3 and the cash register No. of each of the cash registers 1 to 3 from which the sales proceeds were collected are stored in an associated form in a storage unit 22 (see FIG. 4) provided in the terminal 5.

The processing machine 4 includes, on a top surface of a housing thereof, an inlet unit 6 where the sales proceeds is deposited, an outlet unit 7 that dispenses a change fund, etc., to be used for business on the following day; and a returning unit 8 that returns gift vouchers, coupons, torn banknotes, etc., that cannot be recognized by the processing machine 4 among sales proceeds deposited from the inlet unit 6.

The processing machine 4 is configured to be able to recognize and total only cash. The processing machine 4 performs a totaling process on sales proceeds that are collected from the cash registers 1 to 3 by the respective cash register operators and that are then deposited into the inlet unit 6. The processing machine 4 sends to the terminal 5 the number of currency of each denomination and the total amount as cash sales proceeds for each of the cash registers 1 to 3, and temporarily keeps the counted currency for each denomination. In the present embodiment, the processing machine 4 corresponds to the valuable-medium processing machine that performs a counting process on a predetermined kind of valuable medium among valuable media collected from the valuable-medium transaction machines in the present invention. The reference numeral 9 in FIG. 1 denotes a door that is opened and closed when retrieving the deposited currency and when replenishing the currency for dispensing. The reference numeral 10 denotes a keyhole for locking and unlocking the door 9.

The terminal 5 includes a display unit 11 that displays, for example, graphics that indicate an operational state of the processing machine 4 and graphics for guidance of operation procedures of the terminal 5; an operating unit 12 operated by the operator; and a card reader unit 13 that reads recorded designated information from an ID card explained below when the ID card is inserted.

The terminal 5 exerts control on the operation of the processing machine 4 based on an operation of the operating unit 12 performed by the operator, stores in the internal storage unit a result of the counting process that is input from the processing machine 4 and sales proceeds that are other than cash and are manually input by the teller, etc. The terminal manages the sales proceeds for each of the cash registers 1 to 3. In the present embodiment, the terminal 5 corresponds to the control machine that stores and manages the numerical quantity of the valuable media collected from the valuable-medium transaction machines for each of the valuable-medium transaction machine. The cash registers 1 to 3 are connected to the terminal 5 via a communication line.

Particularly, the valuable medium processing system S according to the present embodiment is configured so that, when continuously storing the numerical quantity of currency, valuable media other than currency, damaged currency, etc., in sales proceeds collected from the cash registers 1 to 3 in the internal storage unit of the terminal 5, while the processing machine 4 performs a counting process on currency collected from one of the cash registers 1 to 3, the operator can manually continuously input through the operating unit 12 the numerical quantity of valuable media other than currency, damaged currency, etc., collected from another cash register 1, 2, or 3.

When manually inputting the numerical quantity of valuable media during a counting process performed by the processing machine 4, the terminal 5 stores the input numerical quantity of valuable media in the internal storage unit as the numerical quantity of valuable media collected from the cash registers 1 to 3. Concretely, the terminal 5 stores the numerical quantity of valuable media that were manually input and a cash register No. of a cash register from which the valuable media on the numerical quantity were collected in an associated form in the storage unit.

Because of this configuration of the valuable medium processing system S according to the present embodiment, while the processing machine 4 performing a counting process on currency as almost all of sales proceeds collected from one of the cash registers 1 to 3, the numerical quantity of valuable media other than currency collected from the cash registers 1, 2, or 3 from which cash undergoing a counting process was collected and the numerical quantity of valuable media other than currency collected from a cash register 1, 2, or 3 other than the cash register 1, 2, or 3 from which the cash undergoing a counting process was collected can be manually continuously stored in the terminal 5. Therefore, the work efficiency of the operator who performs a totaling operation for sales proceeds can be improved.

Figures 1A, 2:
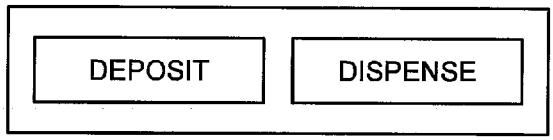

An example of a cash deposit operation of the valuable medium processing system S according to the present embodiment is explained with reference to FIGS. 2-1 and 2-2. FIGS. 2-1 and 2-2 depict examples of graphics displayed on the display unit 11 of the terminal 5 when the operator performs a cash deposit operation.

In the valuable medium processing system S, before the operator starts a cash deposit operation, the display unit 11 of the terminal 5 displays thereon a screen for the operator to select cash deposit or cash dispensing as a standby display as shown in FIG. 2-1A.

Figures 1B, 2:
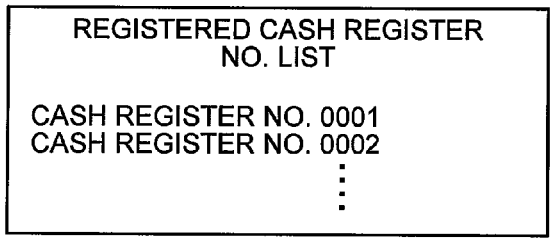

When the operator operates the operating unit 12 to select the cash deposit, the display unit 11 displays thereon the cash register Nos. of the cash registers 1 to 3 that were in operation on the current day as a registered cash-register No. list as shown in FIG. 2-1B. In the valuable medium processing system S, sales proceeds collected from the cash registers 1 to 3 are totaled in the order of the cash register Nos. corresponding to the cash registers 1 to 3 shown in the registered cash-register No. list. The cash register Nos. are displayed on the display unit 11 by sending information representing that the cash registers 1 to 3 were in operation on the current day from each cash register to the terminal 5 via the communication line and by registering the information in the terminal 5.

Figures 1C, 2:
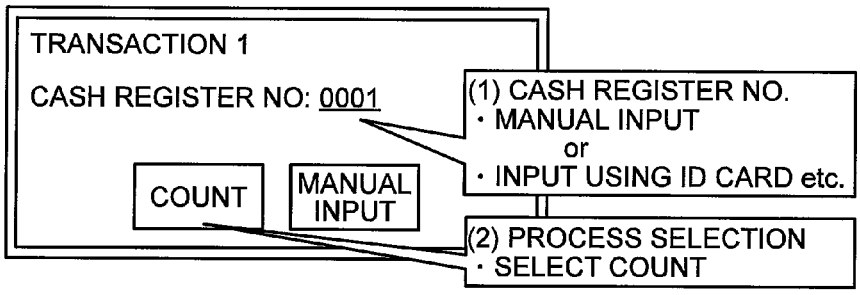

Thereafter, the display unit 11 displays thereon a screen to prompt the operator to input the cash register No. of the cash register 1, 2, or 3 to start a totaling operation and select whether to cause the processing machine 4 to perform a totaling process on currency or to manually input the numerical quantity of valuable media other than currency through the operating unit 12 as shown in FIG. 2-1C.

When the operator of the operating unit 12 of the terminal 5 is to count sales proceeds collected from all the cash registers 1 to 3 alone, the operator performs an operation of selecting the counting or the manual inputting, without inputting the cash register No. As a result, the collected sales proceeds are totaled in the order from a cash register corresponding to the cash register No. 0001 displayed at the top of the registered cash-register No. list on the terminal.

Thus, in the valuable medium processing system S of the present embodiment, the cash register Nos. of the cash registers 1 to 3 that were in operation on the current day are registered beforehand in the terminal 5, and then sales proceeds are totaled in sequence in the order of the registered cash-register No. list. Therefore, for example, when one person, such as the teller, performs a totaling operation for sales proceeds collected from all the cash registers 1 to 3, the teller need not input the cash register No. for every operation when totaling the sales proceeds collected from the cash registers 1 to 3. Thereby, the efficiency of the totaling operation can be improved.

When a cashier is to count only sales proceeds collected from the cash register 1, 2, or 3 to which the cashier is assigned, the cashier manually inputs the cash register No. of the assigned cash register 1, 2, or 3 or inserts the predetermined ID card to the card reader unit 13 in the terminal 5 to thereby select the cash register 1, 2, or 3 to start totaling the sales proceeds (Process 1 in FIG. 2-1).

The cash register No. is recorded beforehand on the ID card to be inserted in the card reader unit 13. In the terminal 5, the card reader unit 13 reads the recorded cash register No. from the inserted ID card, and the cash register No. is interruptingly registered at the top of the registered cash-register No. list.

When one cashier is to collect and total sales proceeds collected from a predetermined number of the cash registers 1 to 3, the cash register Nos. of the predetermined number of the cash registers 1 to 3 for which the operator performs totaling are recorded beforehand on the ID card.

Thereby, the cashier who totals the sales proceeds collected from the predetermined number of the cash registers 1 to 3 merely has to insert the ID card in the card reader unit 13 to interruptingly register on the registered cash-register No. list the cash register Nos. of the predetermined number of the cash registers for which the operator performs a totaling operation.

As described above, in the valuable medium processing system S of the present embodiment, the cashier inputs the cash register Nos. of the cash registers 1 to 3 to which the operator is assigned for a totaling operation, manually or using the ID card. Thereby, the order of the totaling operations pertaining to the cash registers 1 to 3 is interruptingly registered in the terminal 5. Therefore, when the terminal 5 is vacant, the operator can perform a totaling operation for the cash registers 1 to 3 to which the operator is assigned, without waiting for a totaling operation performed by another cashier. This improves the work efficiency of the totaling operation.

Figures 1D, 2:
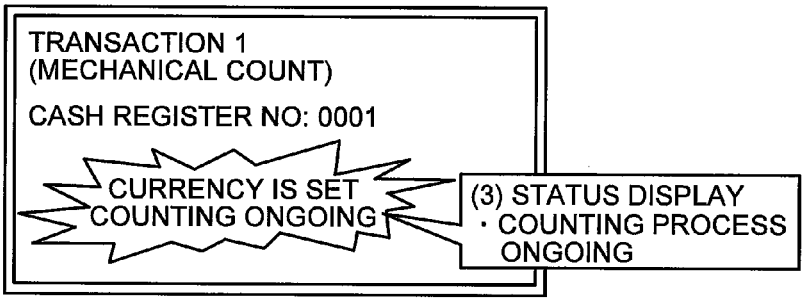

When the operator selects a counting process on the screen shown in FIG. 2-1C (Process 2) and deposits currency (cash) among sales proceeds into the inlet unit 6 of the processing machine 4, the processing machine 4 starts a counting process, and the display unit 11 of the terminal 5 displays thereon a status display (counting ongoing display) showing that the counting process is ongoing as shown in FIG. 2-1D (Process 3).

Figures 1E, 2:
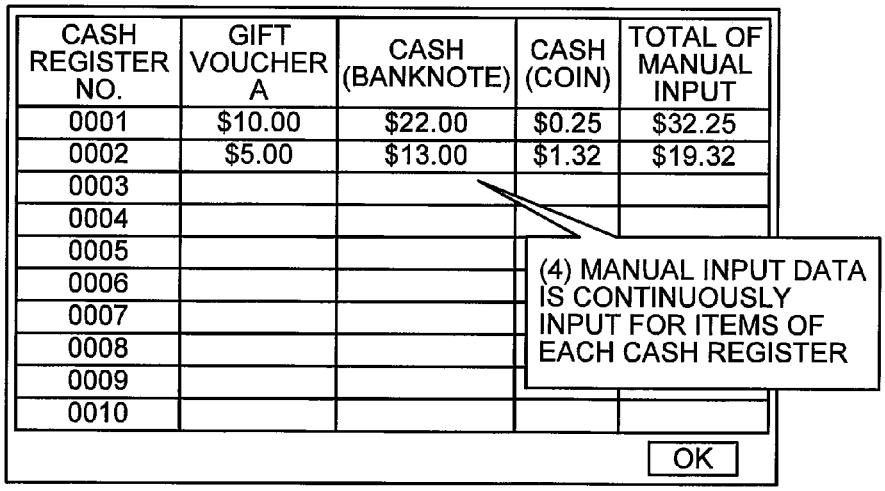

Thereafter, during the counting process performed by the processing machine 4, the terminal 5 automatically switches the screen of the display unit 11 and displays a screen (manual input item list display) to prompt the operator to manually input the numerical quantity of valuable media other than currency, etc., for each of the cash registers 1 to 3 as shown in FIG. 2-1E.

The operator operates the operating unit 12 to input gift vouchers A, torn or damaged cash (banknotes), cash (coins) that cannot be recognized by the processing machine, the total amount thereof, etc., onto this manual input item list (Process 4).

Figures 1A, 3:
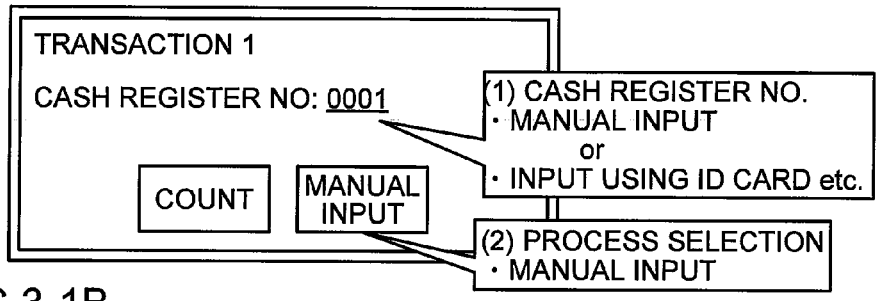
Figures 1B, 3:
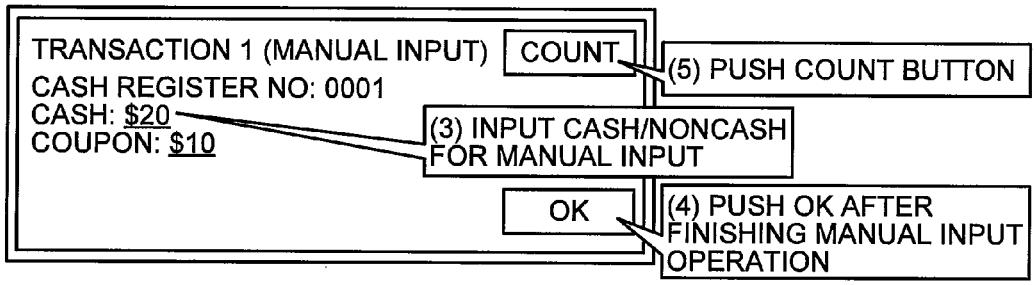
Figures 1C, 3:
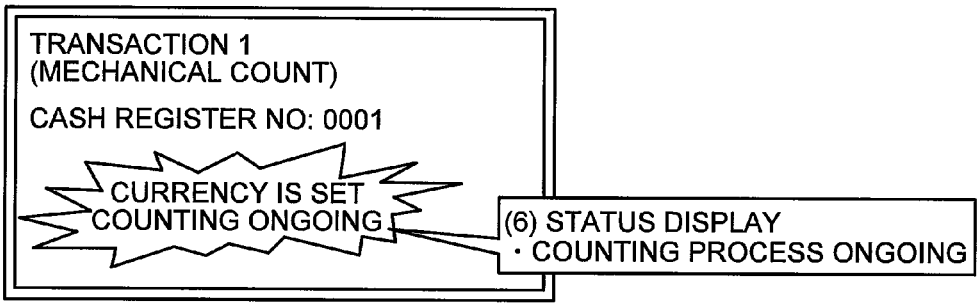
Figures 1D, 3:
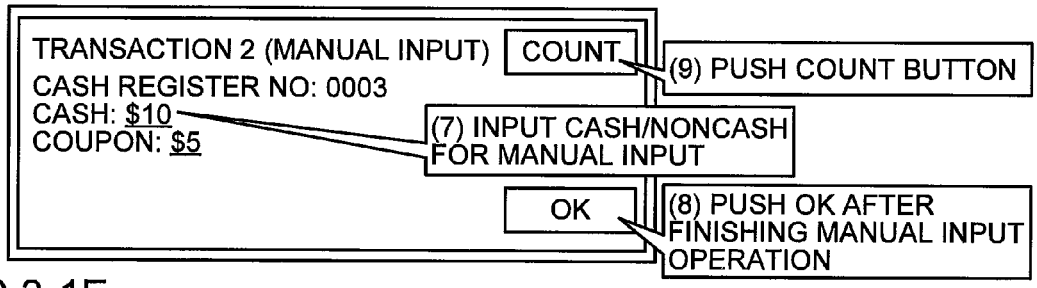
Figures 1E, 3:
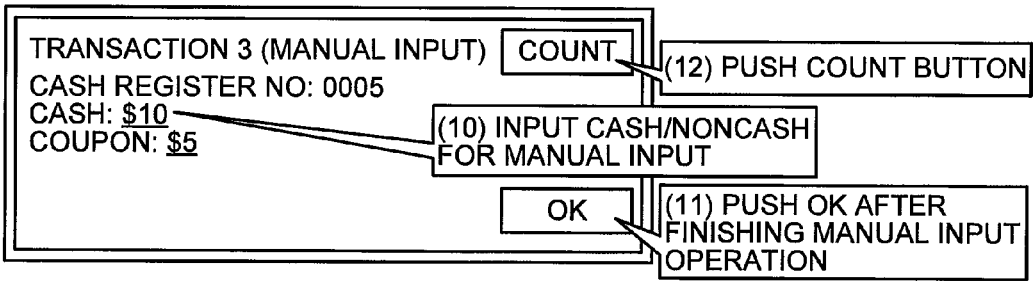
Figures 2F, 3:
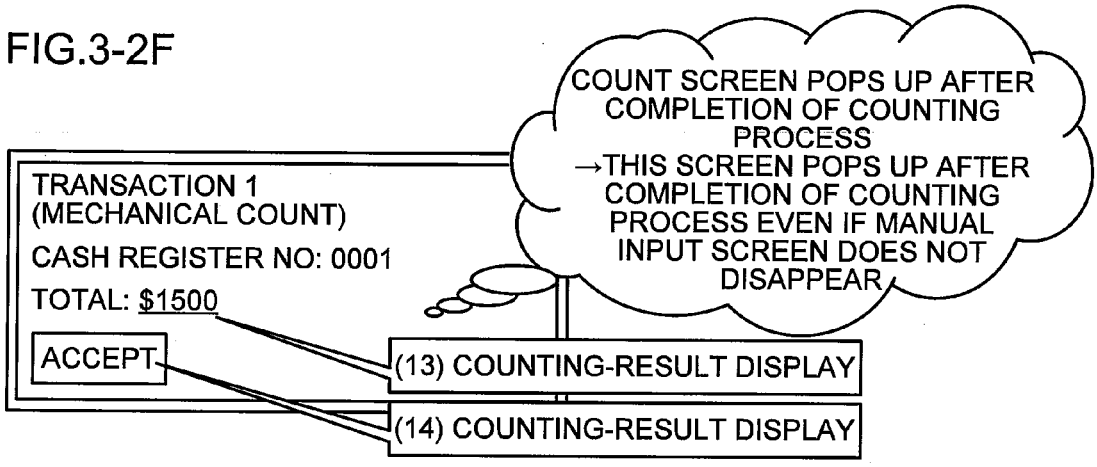

Next, when the processing machine 4 completes the counting process, the terminal 5 displays on the display unit 11 a counting-result display that shows the processing result as shown in FIG. 2-2F (Process 5). That is, even if all of manual input operations are not completed, the terminal 5 in the present embodiment displays the counting-result display on the display unit 11 when the processing machine 4 completes the counting process.

Thereby, the operator can surely know completion of the counting process performed by the processing machine 4. Therefore, immediately after a counting process pertaining to a certain cash register 1, 2, or 3 is completed, a counting operation can be performed through the operating unit 12 (see FIG. 4) of the terminal 5 to deposit currency collected from another cash register 1, 2, or 3 into the processing machine 4 and to cause the processing machine 4 to start the next counting process. This improves the efficiency of the totaling operation for sales proceeds.

Figures 2G, 3:
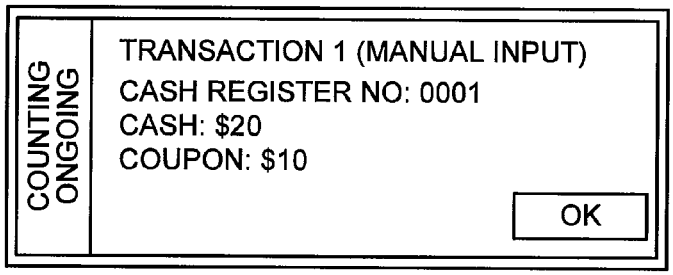

When the operator performs a confirming operation through the operating unit 12 when the counting-result display is displayed, the terminal 5 displays on the display unit 11, instead of the counting-result display, a screen (manual input item list display) to prompt the operator to manually input the numerical quantity of valuable media other than currency, etc., for each of the cash registers 1 to 3 again as shown in FIG. 2-2G.

The operator continuously inputs gift vouchers A, torn or damaged cash (banknotes), cash (coins) that cannot be recognized by the processing machine, the total amount thereof, etc., onto this manual input item list. When the operator completes the manual input operation for valuable media other than currency, etc., collected from all of the cash registers 1 to 3 and then performs a confirming (OK) operation, the terminal 5 displays, on the display unit 11, a screen that shows a status of the counting process performed by the processing machine 4.

Figures 2H, 3:
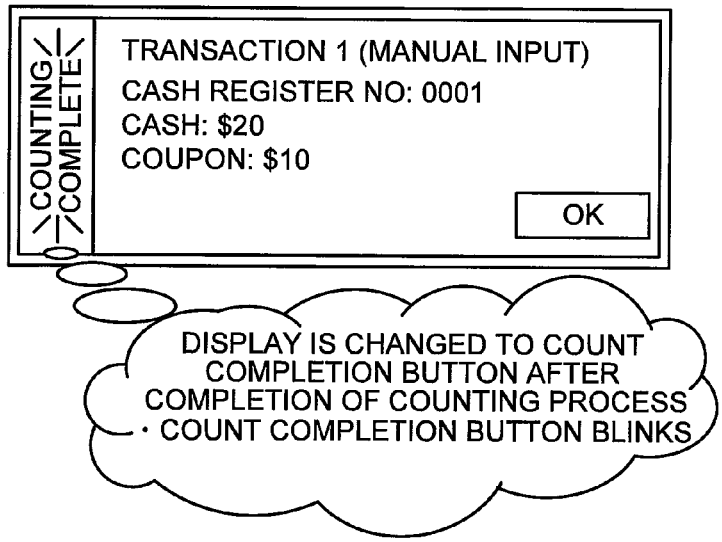

When the processing machine 4 is currently performing a counting process, the terminal 5 displays a status display (for example, see FIG. 2-1D) showing that the counting process in ongoing. When the next counting process is completed, the terminal 5 displays on the display unit 11 a counting-result display that shows the result of the counting process as shown in FIG. 2-2H.

Thereafter, the terminal 5 displays on the display unit 11 a screen to prompt the operator to start the next counting process pertaining to the cash registers 1 to 3 for which the processing machine 4 has not performed the counting process on the registered cash-register No. list as shown in FIG. 2-2I. Then, when the processing machine 4 completes the counting process on all of the cash registers 1 to 3, and manual inputting of the numerical quantity of valuable media is completed, the operator ends the totaling operation for sales proceeds. All the results of the totaling operations of the operator are stored and managed for each of the cash registers 1 to 3 in the terminal 5.

In the above explanation of the totaling operation of the operator, a case in which the operator first selects the counting process is presented as an example. However, there may arise a situation where the operator may first select the manual input operation. Therefore, an example of the totaling operation when the operator first selects the manual input operation is explained next with reference to FIGS. 3-1 and 3-2. Meanwhile, a case of performing the totaling operation for sales proceeds collected from three or more cash registers is explained below.

After the terminal 5 displays on the display unit 11 the registered cash-register No. list shown in FIG. 2-1B, the operator manually inputs the cash register No. or inserts the ID card in the card reader unit 13 to interruptingly register in the terminal 5 the cash register No. (cash register 1 having the cash register No. 0001 in this case) for which the totaling operation is started (Process 1) as shown in FIG. 3-1A. Thereafter, when the manual inputting is selected (Process 2), the terminal 5 displays on the display unit 11 a screen to prompt the operator to manually input the numerical quantity of valuable media other than currency, etc., pertaining to the cash register 1 registered by the operator as shown in FIG. 3-1B. Based on the contents of this screen, the operator manually inputs through the operating unit 12 the numerical quantity of currency (cash), coupons, etc., that cannot be recognized by the processing machine 4 (Process 3).

Then, the operator ends the manual input operation pertaining to the cash register 1 to perform a confirming (OK) operation (Process 4), thereafter performs a counting operation (Process 5) to deposit currency into the processing machine 4, and causes the processing machine 4 to perform a counting process pertaining to the cash register (cash register 1 having the cash register No. 0001 in this case).

When the processing machine 4 starts the counting process, the terminal 5 displays on the display unit 11 a status display that shows ongoing of the counting process pertaining to the cash register 1 having the cash register No. 0001 as shown in FIG. 3-1C (Process 6).

Thereafter, the terminal 5 displays on the display unit 11 a screen to prompt the operator to manually input the numerical quantity of valuable media other than currency collected from the next cash register (cash register 3 having the cash register No. 0003 in this case) on the registered cash-register No. list as shown in FIG. 3-1D.

Even while displaying this screen, the terminal 5 displays on the display unit 11 a counting-result display that shows the result of the counting process pertaining to the cash register 1 as shown in FIG. 3-2F when completing the counting process pertaining to the cash register 1 (Process 13). Thereafter, when the operator performs a confirming operation (Process 14), the terminal 5 displays on the display unit 11 a screen to prompt the operator to perform the counting process on the next cash register for which the counting process is not performed.

Thereafter, when the processing machine 4 starts the next counting process, the terminal 5 again displays on the display unit 11 a screen to prompt the operator to manually input the numerical quantity of valuable media other than currency as shown in FIG. 3-1D. Based on the contents of this display, the operator manually inputs through the operating unit 12 the numerical quantity of currency, coupons, etc., that cannot be recognized by the processing machine 4 (Process 7).

Thereafter, the operator ends the manual input operation pertaining to the cash register 3 and then performs a confirming (OK) operation (Process 8). At this time, if the counting process pertaining to the cash register 1 was already completed, the operator performs a counting operation (Process 9) to deposit currency collected from the next cash register (cash register 3 having the cash register No. 0003 in this case) into the processing machine 4, and causes the processing machine 4 to perform a counting process pertaining to the cash register 3.

Next, when the processing machine 4 starts the counting process, the terminal 5 displays on the display unit 11 a screen to prompt the operator to manually input the numerical quantity of valuable media collected from the cash register having the cash register No. 0005 as shown in FIG. 3-1E. Based on the contents of this screen, the operator then manually inputs through the operating unit 12 the numerical quantity of currency (cash), coupons, etc., that cannot be recognized by the processing machine 4 (Process 10).

Then, the operator ends the manual input operation pertaining to the cash register having the cash register No. 0005 to perform a confirming (OK) operation (Process 11). When a cash register for which the counting process has not yet been performed exists on the registered cash-register No. list, the operator performs a counting operation (Process 12) to deposit currency into the processing machine 4, and causes the processing machine 4 to perform the counting operation pertaining to the cash register.

Then, when the processing machine 4 completes the counting process on all of the cash registers, and manual inputting of the numerical quantity of valuable media is also completed, the operator ends the totaling operation for sales proceeds. All the results of the totaling operations done by the operator are stored and managed on a cash register basis in the terminal 5.

The present embodiment is configured so that, if the processing machine 4 starts the counting process, the display unit 11 displays thereon a status display that shows a status of this process and thereafter automatically switches the display to a screen that prompts the operator to perform the manual inputting. However, any other display form may be employed which can display a screen to prompt the operator to perform the manual inputting during the counting process.

For example, it is possible to configure the display unit 11 to display on a display screen thereof a status display showing that the counting process is ongoing and a screen to prompt the operator to perform the manual inputting on the same screen as shown in FIG. 3-2G. In this case, the screen to prompt the operator to perform the manual inputting is preferably displayed so as to be larger than the status display showing that the counting process is ongoing. Then, when the counting process ends, the display unit 11 displays thereon a result display that shows completion of the counting process as shown in FIG. 3-2H, instead of the status display showing that the counting process is ongoing. In this case, the result display is preferably highlighted, for example, by blinking the display.

Figure 4:
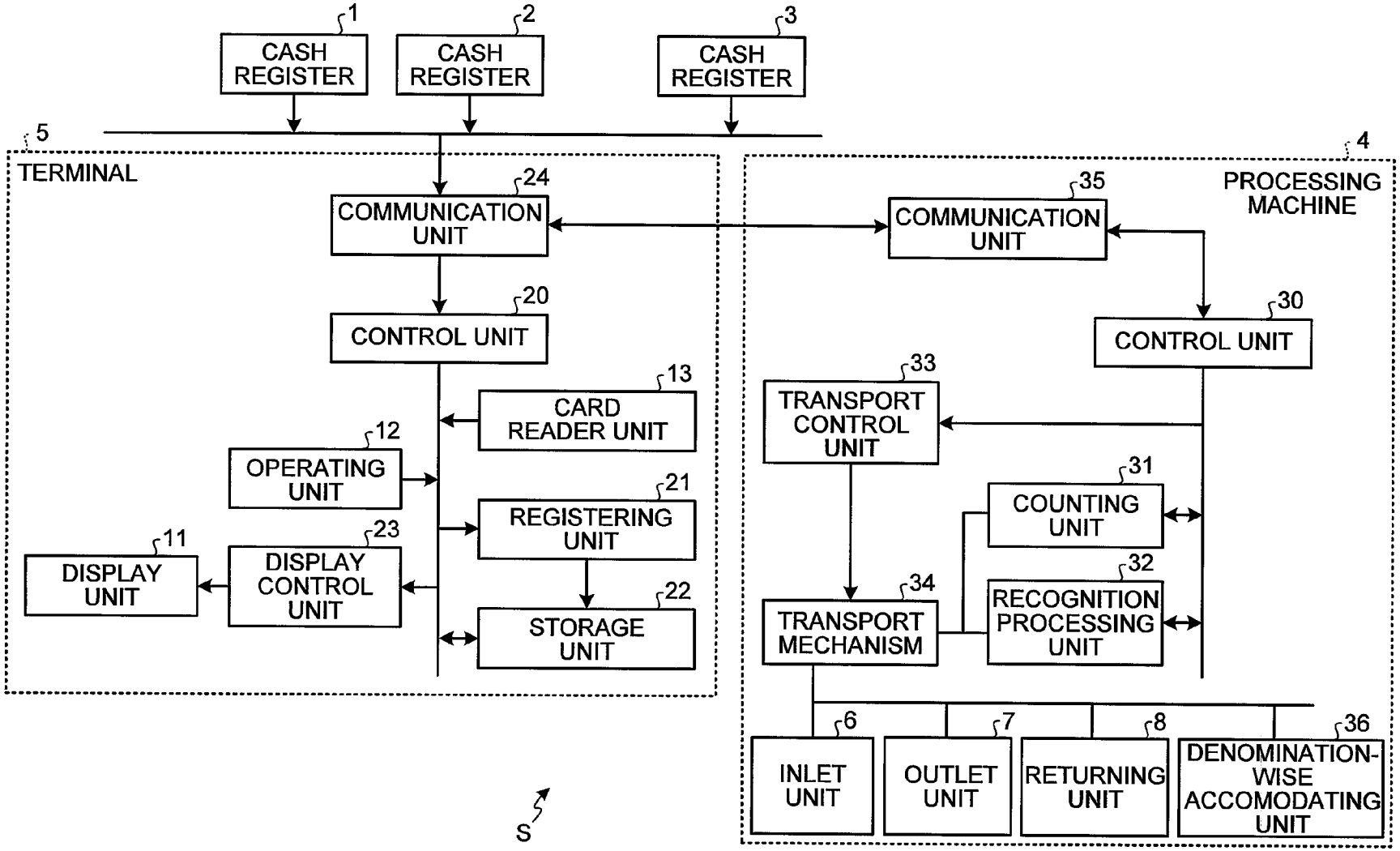
FIG. 4 is a functional block diagram of a structure of the valuable medium processing system according to the present embodiment.

Next, a structure of the valuable medium processing system S according to the present embodiment is explained with reference to FIG. 4. FIG. 4 is a functional block diagram of the structure of the valuable medium processing system S according to the present embodiment.

The valuable medium processing system S of the present embodiment includes the processing machine 4 and the terminal 5 as shown in FIG. 4. The terminal 5 and the processing machine 4 are interconnected so as to be able to send and receive various types of information to and from each other. The terminal 5 is connected to the cash registers 1 to 3 via the communication line.

The processing machine 4 includes a control unit 30, a counting unit 31, a recognition processing unit 32, a transport control unit 33, a transport mechanism 34, a communication unit 35, the inlet unit 6, the outlet unit 7, the returning unit 8, and a denomination-wise accommodating unit 36.

The inlet unit 6 is configured to take deposited banknotes inside the processing machine 4 one banknote at a time, based on the control exerted by the control unit 30. The outlet unit 7 is configured to dispense currency accommodated in the denomination-wise accommodating unit 36 to the outside of the processing machine 4, based on the control exerted by the control unit 30. The returning unit 8 is configured to return gift vouchers, coupons, significantly damaged currency, etc., determined to be unable to be handled by the processing machine 4 to the outside of the processing machine 4.

The denomination-wise accommodating unit 36 is configured to accommodate recognized banknotes of respective denominations under control of the control unit. The transport mechanism 34 is configured to transport banknotes among the inlet unit 6, the outlet unit 7, the returning unit 8, the denomination-wise accommodating unit 36, the counting unit 31, and the recognition processing unit 32. The communication unit 35 is a communication interface for sending and receiving various types of information, directive commands, etc., to and from the terminal 5. The transport control unit 33 exerts control on the operation of the transport mechanism 34 according to the control exerted by the control unit 30.

Based on the control exerted by the control unit 30, the recognition processing unit 32 is configured to capture an image of each banknote taken inside from the inlet unit 6, obtain a plurality of types of image information pertaining to each banknote, and recognize the authenticity, denomination, fitness, etc., of the banknote based on the image information. The recognition processing unit 32 also sends a recognition result of currency to the control unit 30. In the present embodiment, the recognition processing unit 32 corresponds to a recognition unit that recognizes a predetermined denomination of valuable medium among valuable media collected from the valuable-medium transaction machines in the present invention.

Based on the recognition result obtained by the recognition processing unit 32, the counting unit 31 is configured to automatically perform a counting process on the numerical quantity of currency of each denomination, the control unit 30 having determined that the currency can be handled by the processing machine 4. The counting unit 31 sends the counting result of the currency to the control unit 30. In the present embodiment, the counting unit 31 corresponds to a counting unit that performs a counting process on valuable media that can be recognized by the recognition unit in the present invention.

The control unit 30 includes a CPU (Central Processing Unit), a ROM (Read-Only Memory), and a RAM (Random Access Memory). Based on various directive commands sent from a control unit 20 of the terminal 5 explained below, the CPU reads and executes a suitable information processing program from among various types of information processing programs stored in the ROM. Thereby, the control unit 30 performs a plurality of types of processes pertaining to banknotes and performs, for example, a process of sending to the terminal 5 a result of a counting process performed by the counting unit 31. Furthermore, the RAM serves as a temporary storage area used by the CPU as a working area when the CPU executes the various information processing programs stored in the ROM.

The control unit 30, the counting unit 31, the recognition processing unit 32, the transport control unit 33, and the communication unit 35 are interconnected with a bus used for information communication.

Next, a structure of the terminal 5 is explained. The terminal 5 includes the control unit 20, the operating unit 12, a display control unit 23, the display unit 11, the card reader unit 13, a registering unit 21, the storage unit 22, and a communication unit 24.

The communication unit 35 is a communication interface for receiving various directive commands, etc., sent from the control unit 20 of the terminal 5 to the control unit 30 of the processing machine 4 and for receiving a counting result of currency, etc., from the control unit 30 of the processing machine 4 to send the received result, etc., to the terminal 5.

The operating unit 12 is a keyboard operated, for example, when the operator operates the processing machine 4, inputs to the terminal the numerical quantity of valuable media other than currency, and registers a cash register No.

Information that is input by the operation of the operating unit 12 is sent to the control unit 20. If the received information relates to a cash register No. for registering, the control unit 20 causes the registering unit 21 to store the cash register No. in the storage unit 22. If the received information relates to the numerical quantity of valuable media, the control unit 20 causes the registering unit 21 to interruptingly register the numerical quantity as the numerical quantity on the cash register of the registered cash-register No. list in the storage unit 22. If the received information is information for operating the processing machine 4, the control unit 20 sends directive commands corresponding to the information to the processing machine 4. In the present embodiment, the operating unit 12 corresponds to an input operation unit used for inputting the numerical quantity of valuable media that cannot be recognized by the recognition unit in the present invention.

The card reader unit 13 is configured to read from a ID card a cash register No. recorded on the ID card, and to send the read cash register No. to the control unit 20. The control unit 20 causes the registering unit 21 to interruptingly register, on the registered cash-register No. list in the storage unit 22, the cash register No. received from the card reader unit 13. In the present embodiment, the card reader unit 13 corresponds to an identification information reading unit for reading identification information from a recording medium that records thereon the identification information assigned for identifying the valuable-medium transaction machines in the present invention.

The storage unit 22 is a high-capacity non-volatile memory such as a flash memory. Based on information sent to the terminal 5 from the cash registers 1 to 3 that were in operation on the current day, the storage unit 22 stores therein cash register Nos. of those cash registers 1 to 3 as the registered cash-register No. list, and also registers and stores on the registered cash-register No. list a cash register No. that is input using the ID card or manually through the operating unit 12.

The storage unit 22 also stores therein a counting result of currency sent from the processing machine 4 to the terminal 5 and the numerical quantity of valuable media that was manually input through the operating unit 12 for each of the cash registers 1 to 3 in an associated manner with cash register Nos. of the cash registers 1 to 3 from which those currency and valuable media were collected. In the present embodiment, the storage unit 22 corresponds to a storage unit that stores therein the numerical quantity of valuable media that was input through the input operation unit and a counting result obtained by the counting unit in the present invention.

According to the control exerted by the control unit 20, the registering unit 21 performs a process of registering beforehand on the registered cash-register No. list in the storage unit 22 a cash register No. (registration information) sent to the terminal 5 from each of the cash registers 1 to 3 that were in operation on the current day. Based on the order of the cash register Nos. registered on the registered cash-register No. list by the registering unit 21, the terminal 5 stores in the storage unit 22 a counting result of currency and the numerical quantity of valuable media other than currency on a cash register basis. In the present embodiment, the registering unit 21 corresponds to a registration unit that registers beforehand the order of valuable-medium transaction machines. In the present invention, the numerical quantity of valuable media collected from each of the valuable-medium transaction machines is stored in the storage unit based on the order.

When a cash register No. is input using the ID card or manually through the operating unit 12, the registering unit 21 performs a process of interruptingly registering the cash register No. at the top of the registered cash-register No. list. In this case, a counting result of currency and a manually input numerical quantity of valuable media, that are collected from a cash register corresponding to the interruptingly registered cash-register No., are stored in the storage unit 22 in prior to a counting result and the numerical quantity on the cash register registered before the interruptive registration.

The display unit 11 includes a liquid crystal display device and displays, for example, graphics that indicate an operational state of the processing machine 4 and graphics for guidance of operation procedures of the terminal 5 based on the control exerted by the display control unit 23. In the present embodiment, the display unit 11 corresponds to a display unit that displays graphics pertaining to a process to be performed on valuable media in the present invention.

According to the control exerted by the control unit 20, while the processing machine 4 performs a counting process, the display control unit 23 displays on the display unit 11 graphics to prompt the operator to manually input the numerical quantity of valuable media other than currency collected from each of the cash registers 1 to 3 in the order of the cash registers 1 to 3 registered on the registered cash-register No. list, and performs, for example, switching of screens displayed on the display unit 11. In the present embodiment, the display control unit 23 corresponds to a display control unit that exerts display control on the display unit in the present invention.

The control unit 20 includes a CPU, a ROM, and a RAM. The CPU reads and executes a suitable information processing program from among various types of information processing programs stored in the ROM. Thereby, the control unit 20 exerts overall control on operations of the entire valuable medium processing system S, including a control of operations of the processing machine 4. Furthermore, the RAM serves as a temporary storage area used by the CPU as a working area when the CPU executes the various information processing programs stored in the ROM.

Processes executed by the control unit 20 of the terminal 5 by reading the various information processing programs stored in the ROM are explained with reference to FIGS. 5 and 6. When in a powered on state, the control unit 20 repeatedly performs processes shown in flowcharts in FIGS. 5 and 6.

Figure 5:
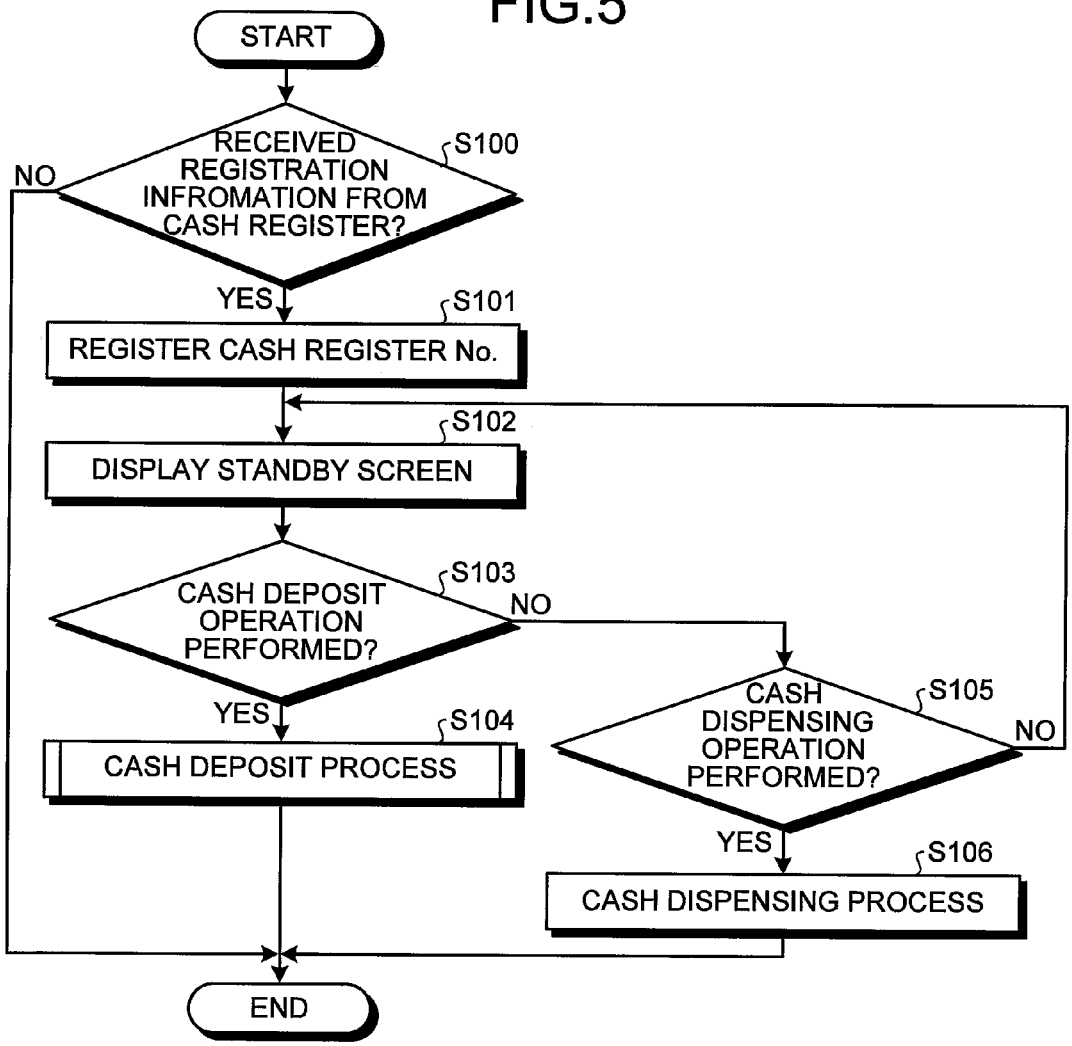
FIG. 5 is a flowchart of processes performed by the terminal according to the present embodiment.
Figure 6:
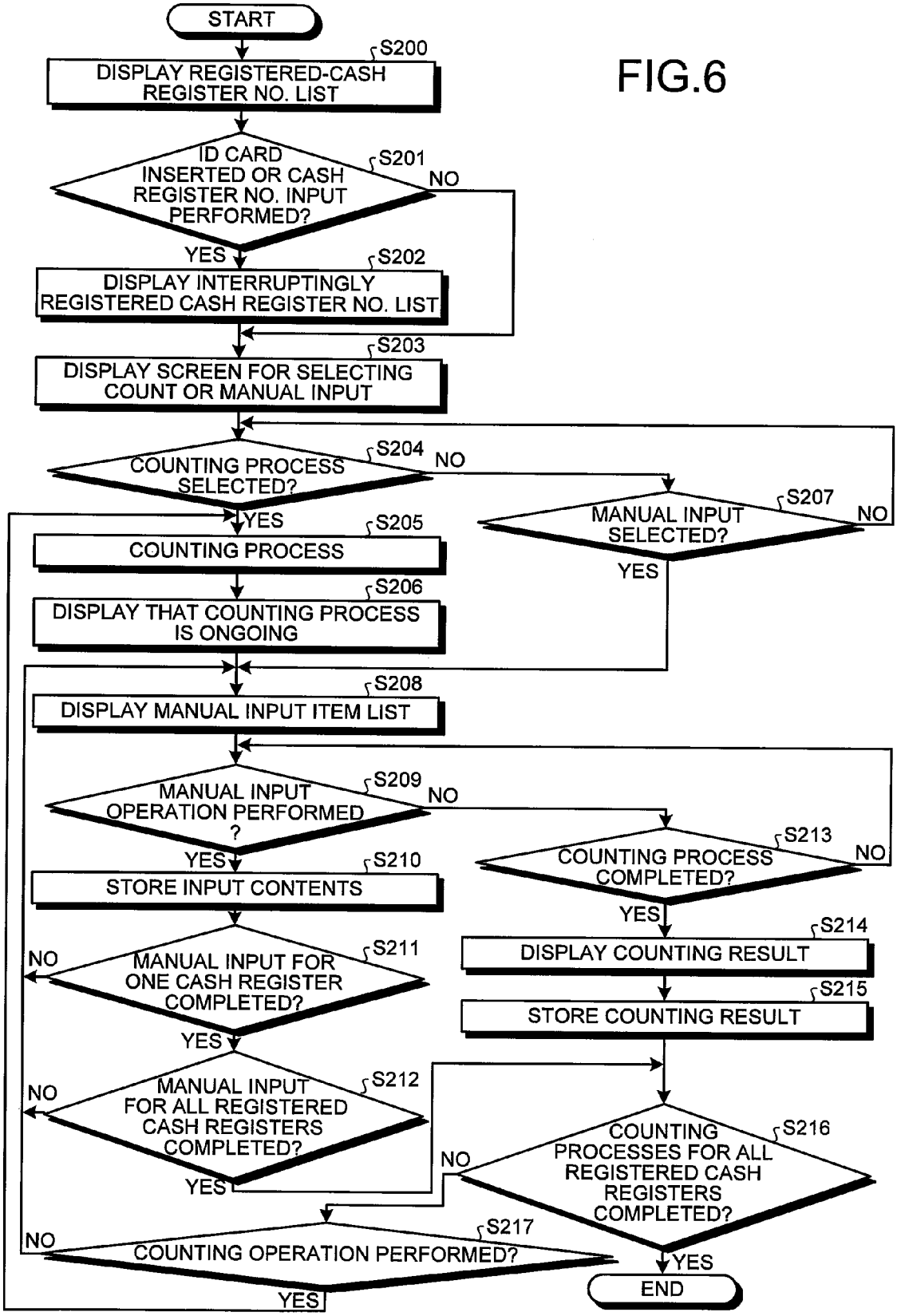
FIG. 6 is a flowchart of processes performed by the terminal according to the present embodiment.

As shown in FIG. 5, when in the powered on state, the control unit 20 first determines whether registration information has been received from the cash registers 1 to 3 via the communication line (Step S100). Upon determining that registration information has been received from the cash registers 1 to 3 (Yes at Step S100), the control unit 20 performs a process of registering on the registered cash-register No. list in the storage unit 22 a cash register No. of the cash registers 1 to 3 that were in operation on the current day (Step S101), and thereafter advances the process to Step S102. Otherwise (No at Step S100), the control unit 20 ends the process.

At Step S102, the control unit 20 displays a standby screen (for example, see FIG. 2-1A) on the display unit 11, thereafter advances the process to Step S103, and determines whether a deposit operation has been performed through the operating unit 12.

Upon determining that the deposit operation has been performed (Yes at Step S103), the control unit 20 advances the process to Step S104, performs a deposit process, and thereafter ends the process. The deposit process will be explained in detail later with reference to FIG. 6.

Upon determining that the deposit operation has not been performed (No at Step S103), the control unit 20 determines whether a dispensing operation has been performed through the operating unit 12 (Step S105). If so (Yes at Step S105), the control unit 20 performs a process for dispensing from the outlet unit 7 the numerical quantity of currency corresponding to the operation (Step S106), and thereafter ends the process. Otherwise (No at Step S105), the control unit 20 advances the process to Step S102.

Next, the deposit process performed by the control unit 20 at Step S104 shown in FIG. 5 is explained with reference to FIG. 6. As shown in FIG. 6, in the deposit process, the control unit 20 first displays on the display unit 11 the registered cash-register No. list (for example, see FIG. 2-1B) that enumerates cash register Nos. of cash registers that were in operation on the current day (Step S200), and thereafter determines whether a cash register No. has been input with the ID card or through the operating unit 12 (Step S201).

Upon determining that the cash register No. has been input (Yes at Step S201), the control unit 20 performs a process of interruptingly registering on the registered cash-register No. list in the storage unit 22 the input cash register No. (Step S202), and thereafter advances the process to Step S203. Otherwise (No at Step S201), the control unit 20 advances the process to Step S203.

At Step S203, the control unit 20 displays on the display unit 11 graphics (for example, see FIG. 2-1C) to prompt the operator to select either a counting process of currency or manual inputting of the numerical quantity of valuable media other than currency, and thereafter determines whether the counting process has been selected (Step S204).

Upon determining that the counting process has been selected (Yes at Step S204), the control unit 20 sends to the processing machine 4 a directive command for starting the counting process, thereby causes the processing machine 4 to start the counting process (Step S205), thereafter displays on the display unit 11 a status display (for example, see FIG. 2-1C) showing that the counting process is ongoing (Step S206), and then advances the process to Step S208.

Upon determining that the counting process has not been selected (No at Step S204), the control unit 20 determines whether the manual input process has been selected (Step S207), and if so (Yes at Step S207), advances the process to Step S208. Otherwise (No at Step S207), the control unit 20 advances the process to Step S204.

At Step S208, the control unit 20 displays on the display unit 11 a screen (manual input item list, for example, see FIG. 2-1E) to prompt the operator to manually input the numerical quantity of valuable media, and thereafter determines whether the numerical quantity of valuable media has been manually input through the unit 12 (Step S209).

Upon determining that the manual inputting has been performed (Yes at Step S209), the control unit 20 performs a process of storing in the storage unit 22 the numerical quantity of valuable media that was manually input (Step S210), and thereafter determines whether manual input process for one cash register has been completed (Step S211). Upon determining that the manual input process for one cash register has been completed (Yes at Step S211), the control unit 20 advances the process to Step S212. Otherwise (No at Step S211), the control unit 20 advances the process to Step S208.

At Step S212, the control unit 20 determines whether the manual input process has been completed pertaining to all of the cash registers registered on the registered cash-register No. list, and if so (Yes at Step S212), advances the process to Step S216. Otherwise (No at Step S212), the control unit 20 advances the process to Step S208.

At Step S209, if determining that manual input process has not been operated (No at Step S209), the control unit 20 determines whether the processing machine 4 has completed a counting process (Step S213), and if so, (Yes at Step S213), advances the process to Step S214. Otherwise (No at Step S213), the control unit 20 advances the process to Step S209.

At Step S214, the control unit 20 displays on the display unit 11 a counting-result display (for example, see FIG. 2-2F) that shows the result of the completed counting process, thereafter stores the counting result in the storage unit 22, and then advances the process to Step S216.

At Step S216, the control unit 20 determines whether counting processes have been completed pertaining to all of the cash registers registered on the registered cash-register No. list, and if so (Yes at Step S216), ends the process.

If determining that counting processes have not been completed pertaining to all of the cash registers (No at Step S216), the control unit 20 determines whether a counting operation has been performed through the operating unit 12 (Step S217). If so (Yes at Step S217), the control unit 20 advances the process to Step S205, otherwise (No at Step S217), advances the process to Step S208.

The above embodiment is configured to directly send, as registration information, a cash register No. to be registered on the registered cash-register No. list to the terminal 5 from each of the cash registers 1 to 3 that were in operation on the current day. However, it may also be configured, for example, to provide a POS server between each of the cash registers 1 to 3 and the terminal 5 and send a cash register No. through the POS server.

In such a structure that the POS server is provided between each of the cash registers 1 to 3 and the terminal 5, after sending from each of the cash registers 1 to 3 to the POS server the numerical quantity of valuable media that needs to be manually input while the processing machine 4 performs a counting process, the numerical quantity of valuable media may be sent from the POS server to the terminal 5 and stored for each of the cash registers 1 to 3 in the storage unit 22 inside the terminal 5.

In the above explanation for the present embodiment, the terminal 5 stores sales proceeds through a counting process and sales proceeds that were manually input by the operator in an associated manner with a cash register No. of each of the cash registers 1 to 3 from which the respective sales proceeds were collected, and manages the sales proceeds for each of the cash registers 1 to 3. However, sales proceeds may also be managed on any other basis instead of each of the cash registers 1 to 3.

Sales proceeds may also be managed, for example, for the cashier of each of the cash registers 1 to 3. When sales proceeds are managed for each cashier, each cashier is assigned unique identification information, and then the terminal 5 stores and manages in the storage unit 22 sales proceeds through a counting process and sales proceeds that were manually input by the operator in an associated manner with the identification information of each cashier.

In this case, the identification information is input to the terminal 5 using an ID card that stores thereon the identification information of the cashier, or input manually by the operator.

Alternatively, the terminal 5 may manage sales proceeds for each predetermined group. The terminal 5 may manage sales proceeds for, for example, each department or each floor of a retail store where each of the cash registers 1 to 3 is installed as the predetermined group.

When sales proceeds are managed for each predetermined group, each of the cash registers 1 to 3 is assigned identification information that can identify the group, and then the terminal 5 stores and manages in the storage unit 22 sales proceeds through a counting process and sales proceeds that were manually input by the operator in an associated manner with the identification information of each group.

In this case, the identification information is input to the terminal 5 with an ID card that stores thereon the identification information of each group, or input manually by the operator.

The invention claimed is:

1. A valuable medium processing system comprising:

a valuable-medium processing machine that performs a counting process on a predetermined kind of valuable medium among valuable media collected from a plurality of valuable-medium transaction machines that conduct a transaction of the valuable medium; and a control machine that stores therein and manages, for each of the valuable-medium transaction machines, the numerical quantity of the valuable media that were collected from the valuable-medium transaction machines, wherein the valuable-medium processing machine includes a recognition unit that recognizes the predetermined kind of the valuable medium among the valuable media collected from the valuable-medium transaction machines, and a counting unit that performs a counting process on the valuable media that can be recognized by the recognition unit, the control machine includes an input operation unit used for inputting the numerical quantity of valuable media that cannot be recognized by the recognition unit, and a storage unit that stores therein the numerical quantity of the valuable media that is input by the input operation unit and a counting result obtained by the counting unit, and when continuously storing in the storage unit the respective numerical quantities of the valuable media collected from the plurality of the valuable-medium transaction machines, when the numerical quantity for a second valuable-medium transaction machine among the valuable-medium transaction machines is input by the input operation unit while the counting unit is currently performing the counting process on valuable media for a first valuable-medium transaction machine among the valuable-medium transaction machines, the numerical quantity of the valuable media that was input for the second valuable-medium transaction machine is stored in the storage unit separately from the numerical quantity of the valuable media for the first valuable-medium transaction machine.

2. The valuable medium processing system according to claim 1, wherein the control machine includes a registration unit that previously registers an order of the valuable-medium transaction machines from which the valuable media are collected and the respective numerical quantities of the collected valuable media are stored in the storage unit, a display unit that displays graphics pertaining to a process to be performed on the valuable media, and a display control unit that exerts display control on the display unit, and the display control unit displays graphics for input process to input by the input operation unit the numerical quantity of the valuable media collected from each of the valuable-medium transaction machines during the counting process, in the order of the valuable-medium transaction machines registered by the registration unit.

3. The valuable medium processing system according to claim 2, wherein the control machine is connected to the valuable-medium transaction machines via a communication line, and the registration unit previously registers the order of the valuable-medium transaction machines based on registration information received from the valuable-medium transaction machines from which the valuable media are collected and the respective numerical quantities of the collected valuable media are stored in the storage unit.

4. The valuable medium processing system according to claim 2, wherein the control machine includes an identification information reading unit that reads identification information from a recording medium that records thereon the identification information assigned for identifying the valuable-medium transaction machines, and the registration unit registers into the order of the valuable-medium transaction machines the valuable-medium transaction machine corresponding to the identification information that is read by the identification information reading unit so as to change the order of the valuable-medium transaction machines from which the valuable media are collected and the respective numerical quantities of the collected valuable media are stored in the storage unit.

5. The valuable medium processing system according to claim 2, wherein when the counting process is completed while the graphics for the input process has been displayed, the display control unit highlights resultant graphics indicating the completion of the counting process on the display unit.

* * * * *